United States Patent [19]

Judd et al.

[11] Patent Number: 4,967,628

[45] Date of Patent: Nov. 6, 1990

[54] COMPACT COMBINED PAPER CUTTER AND PAPER TRIMMER APPARATUS

[75] Inventors: Thomas W. Judd; Edward L. Hames, both of Peterborough, N.H.

[73] Assignee: Curtis Manufacturing Company, Inc., Jaffrey, N.H.

[21] Appl. No.: 333,188

[22] Filed: Apr. 4, 1989

[51] Int. Cl.[5] ..... B26D 7/02

[52] U.S. Cl. ..... 83/455; 83/456; 83/465; 83/468.2; 83/468.6; 83/564; 83/578; 83/588; 83/614; 83/635; 83/636

[58] Field of Search ..... 83/455, 456, 459, 462, 83/465, 468.2, 468.6, 468.5, 468.7, 564, 578, 588, 614, 635, 637, 636; 225/93, 2, 1

[56] References Cited

U.S. PATENT DOCUMENTS

| | | | |
|---|---|---|---|
| 1,344,169 | 6/1920 | Buckingham | 83/455 |
| 3,130,622 | 4/1964 | Eno | 83/456 |
| 3,142,217 | 7/1964 | Busse | 83/455 |
| 4,529,113 | 7/1985 | Elliott | 225/1 |
| 4,657,163 | 4/1987 | Cats | 225/1 |
| 4,754,676 | 7/1988 | Wessels | 83/588 X |
| 4,782,986 | 11/1988 | Loesche | 225/2 X |

*Primary Examiner*—Frank T. Yost
*Assistant Examiner*—Rinaldi Rada
*Attorney, Agent, or Firm*—Richard P. Crowley

[57] ABSTRACT

A compact paper cutter and perforated edge paper trimmer apparatus which comprises: a base, a base cover hingedly connected to the base to move between an open and closed position, the base cover having a slidable knife edge for cutting paper against a hard strip material on the surface of the base when in a closed position over the base, a paper edge guide hingedly connected to the base to move between an edge guide position generally perpendicular to the base and a closed position adjacent the base, and perforated edge holding teeth and a lever to move the teeth between an upright perforated edge holding position above the base surface and a non-holding position below the base surface.

6 Claims, 4 Drawing Sheets

COMPACT COMBINED PAPER CUTTER AND PAPER TRIMMER APPARATUS

BACKGROUND OF THE INVENTION

It is often desirable to make smooth, clean cuts of paper or other thin sheet materials employing a paper cutting apparatus. A variety of paper cutting apparatus have been proposed in the past. Many of such prior art paper cutters include a slidable knife edge in order to affect the cutting of the paper. Typically, such prior art paper cutters are described in U.S. Pat. Nos. 614,407 issued May 15, 1898; 1,895,754, issued Jan. 31, 1933; 2,013,893, issued Sept. 10, 1935; 3,301,117, issued Jan. 31, 1967; 3,973,479, issued Aug. 10, 1976; and 4,056,027, issued Nov. 11, 1977.

In addition to the cutting of paper or a thin sheet material, it is often desirable to remove the perforated edge portions of paper from computer-type printout paper and to discard the torn off, perforated edge portion so removed.

Therefore, it is desirable to provide for a compact, simple, inexpensive, yet effective, paper or thin sheet cutting apparatus which provides for the smooth, clean cut of the paper and which also provides for the holding and guiding of the paper being cut and for the effective, simple and rapid removal of perforated edge portions of computer or other type of paper having a removable perforated edge portion.

SUMMARY OF THE INVENTION

The invention relates to a compact paper cutting and perforated edge paper trimmer apparatus.

Briefly, the invention comprises a compact, simple paper cutting and perforated edge paper trimmer apparatus which includes a base and a hingedly connected cover for the base for holding the paper to be cut or trimmed, the cover the having a slidable, or tension loaded, knife cutting edge thereon to provide for the smooth, clean cut of the paper in the closed, cover paper holding position against a flat, smooth, hard material, such as a glass strip, on the base. In addition, the apparatus includes a hingedly operated and connected edge guide means on the base so that the paper may be retained in a straight edge guided position during the cutting or edge perforation removal, which edge guide means is adapted to move between a closed, locked position on one side of the base where one edge of the guide means forms a slightly raised top edge on the base, and an open, edge guiding position generally perpendicularly to the one side of the base to help guide the paper to be cut or trimmed.

The apparatus includes within the base a perforated edge trimming means which rotatably moves between a perforated edge holding and trimming position and a non-trimming position. The trimming means includes an elongated, rotatable rod with teeth thereon, the teeth projecting upwardly into a perforated edge trimming position wherein the teeth extending upwardly from the top surface of the base and project upwardly through openings in the top surface of the base to receive the perforated edge of a computer-type paper or other perforated edge paper where the edge is to be removed. In operation, the cover is placed in the closed position, and the pulling of the paper outwardly permits the perforated edge of the paper to be torn off by the upright teeth, the cover opened and the torn off perforated edge removed. The edge paper trimming means also provides provisions whereby the teeth may be rotated to a non-trimming position within the base and wherein the teeth are rotatable by an outside lever on the rod at one end of the base to a position within the base and below the base top surface. In addition, and optionally, the edge guide means provides for an elongated slot therein on which a glidable edge guide means may be slidably moved within the slot. Further, the edge guide means fits within a recess in the base in the edge guide closed position to also form an edge guide for the base and cover in the closed paper cutting or edge trimming position.

The paper cutting and trimming apparatus of the invention may be molded of a hard, composite plastic material, such as high impact polystyrene, except for the knife edge which typically is a commercially available, Xacto ®-type, triangular knife edge which may be readily replaced. The knife edge is adapted to move in a cutting manner against a hard, paper cutting glass surface on the top surface of the base to provide a clean, smooth paper cut. The paper cutting and trimming apparatus of the invention is a compact, simple, effective, relatively inexpensive apparatus for the cutting of paper and thin sheet material, as well as for trimming the perforated edges of perforated paper.

In a cutting operation, a paper or other thin sheet material to be cut is placed over the hard strip material on the base, the cover closed and the slidable knife holder pressed down and slid from one to the other end of the elongated groove in the cover. Where the paper is to be trimmed or cut to a particular size of scale, the cover is placed in the open position, and the edge guide bar hingedly swung into the edge guide position perpendicular to the base. One edge of the paper to be cut is then placed along and against the edge guide and the supplement sheet edge guide slid down to the other edge of the paper, the cover closed and the knife holder then slid from one to the other side. The paper cutting operation may be carried out with the teeth in the edge trimming or preferably in the non-trimming position.

The edge trimming operation merely requires the cover to be placed in the open position, the lever rotated to rotate the rod and place the teeth in an upright position extending through the holes in the base. The perforation of the paper edge to be trimmed is then placed over the upright teeth, the cover closed and the paper pulled outwardly to tear the paper from the teeth retained perforated edge portion of the paper. The cover is then opened, and the torn edge portion removed from the teeth and discarded.

The invention will be described for the purposes of illustration only in connection with certain embodiments; however, it is recognized that various modifications, changes, additions and improvements may be made to the illustrated embodiments, all falling within the spirit and scope of the invention.

DESCRIPTION OF THE EMBODIMENTS

Figure 1:
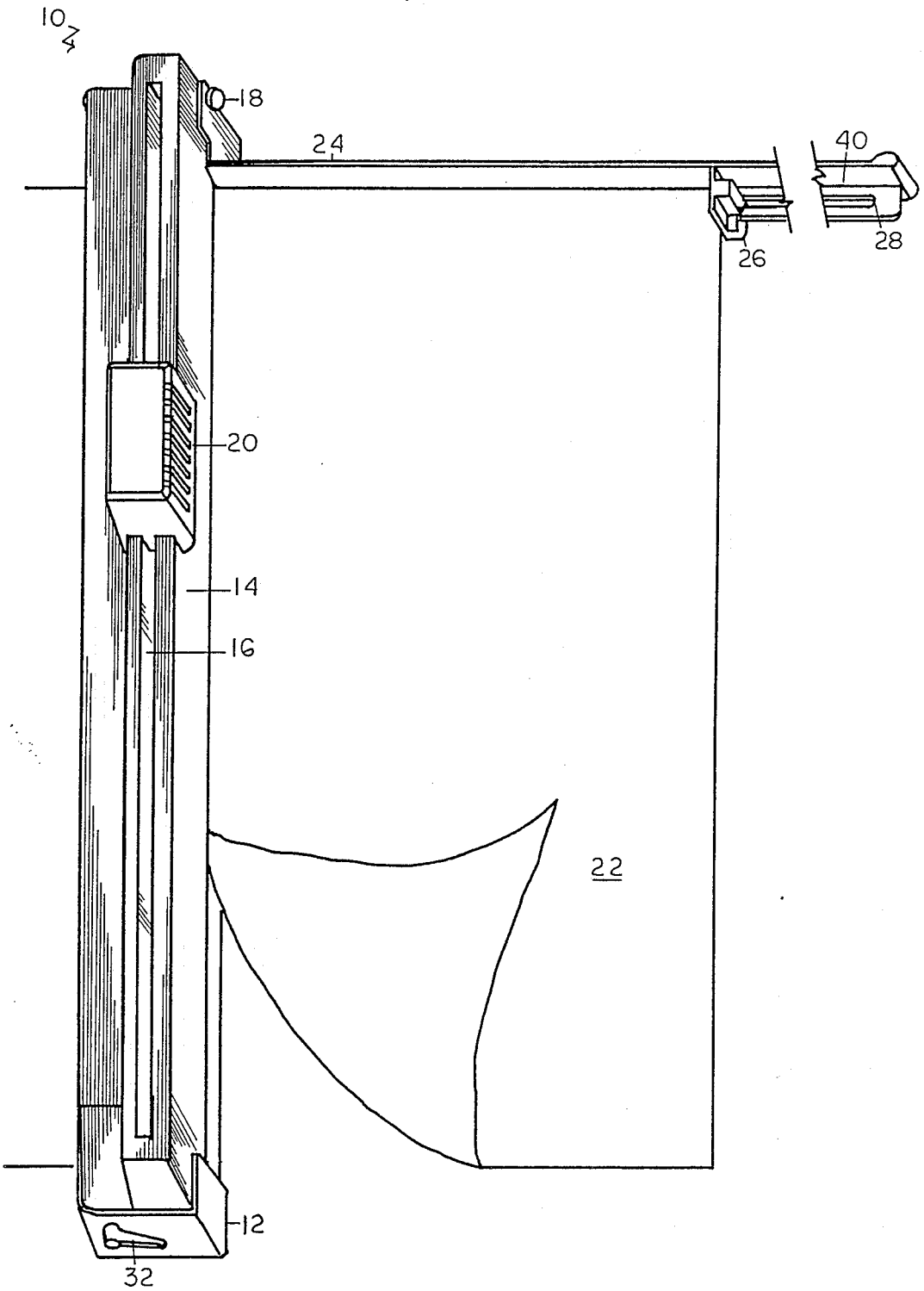
FIG. 1 is a perspective view from above of the paper cutting and trimming apparatus of the invention in the closed position illustrating paper being cut.
Figure 2:
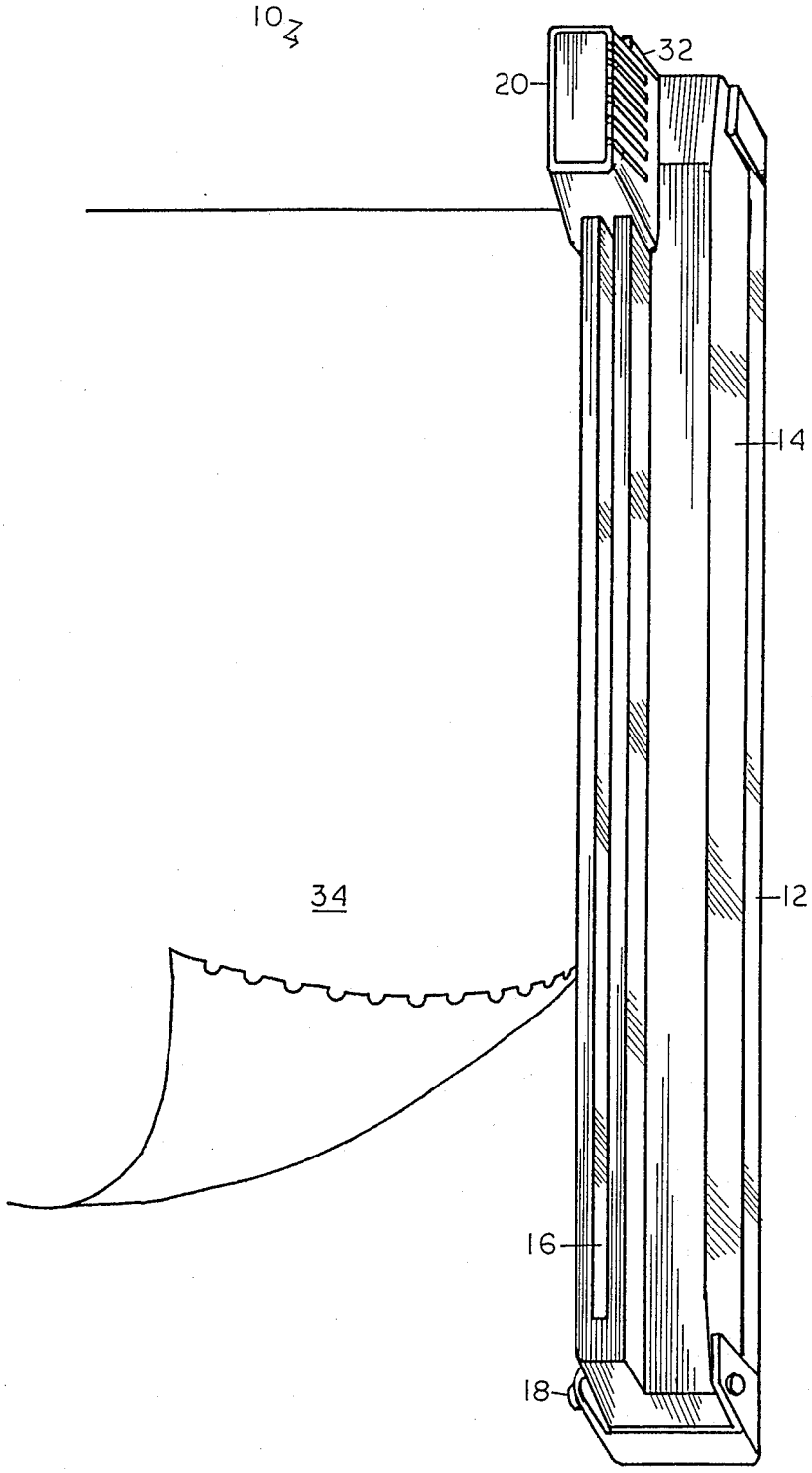
FIG. 2 is a perspective view from above of the paper cutting and trimming apparatus of the invention in the closed position with the perforated edge of paper being removed by a user.
Figure 3:
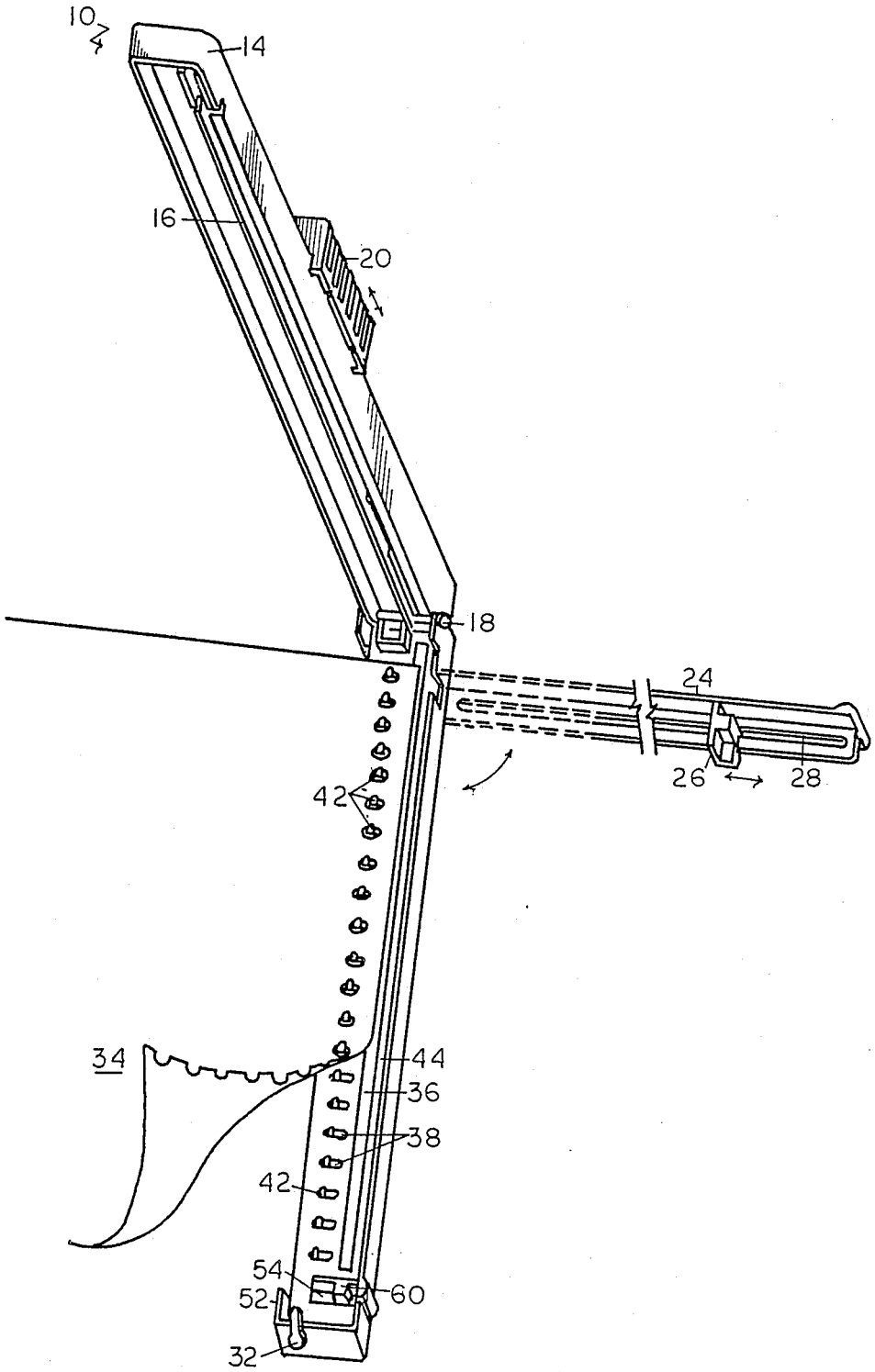
FIG. 3 is an enlarged, fragmentary view of a portion of the base showing the teeth in an upright, edge trimming position.
Figure 4:
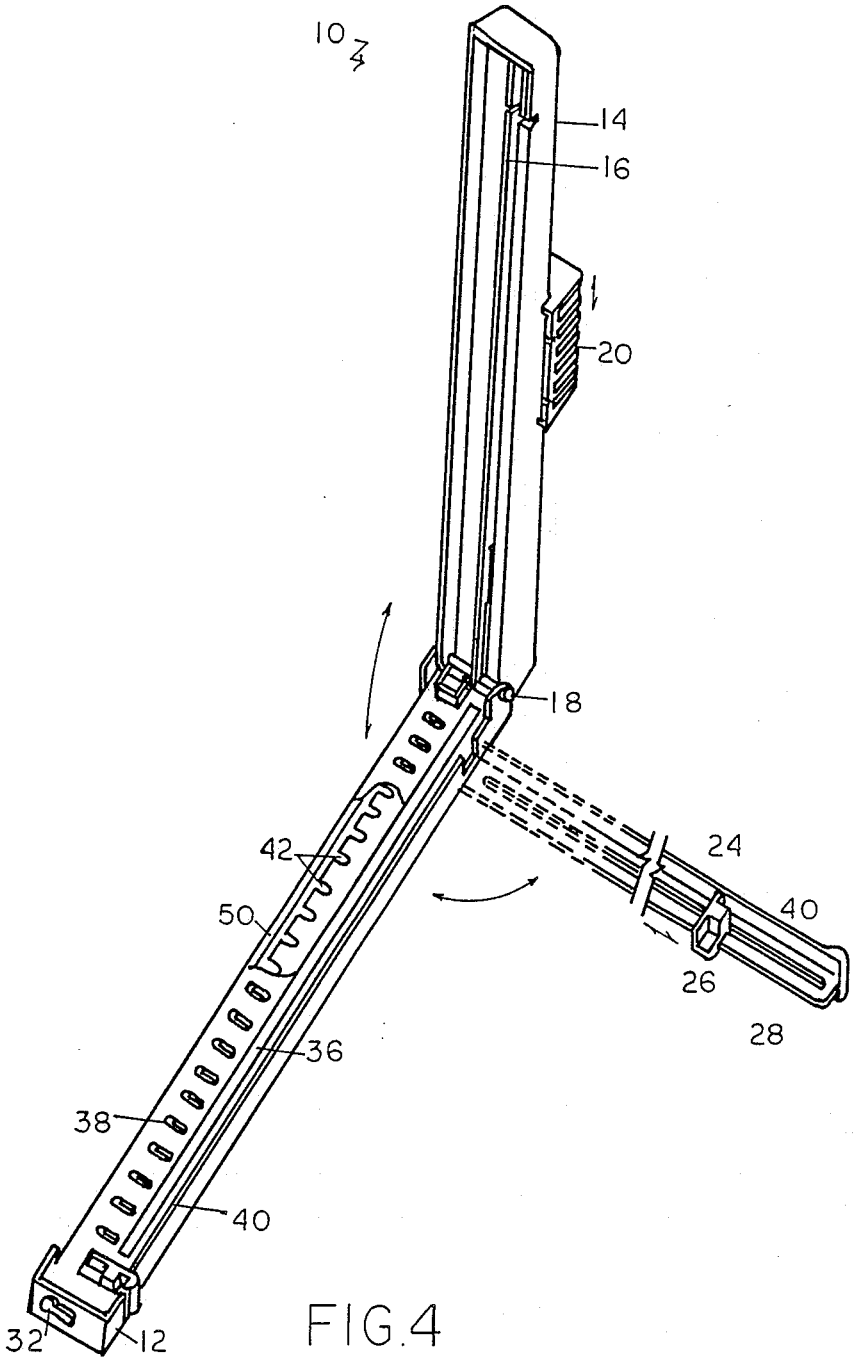
FIG. 4 is a perspective view of the paper cutting and trimming apparatus of the invention in an open position with paper in an edge-cutting position and the base partially cut away showing the teeth attached to the elongated, protractable rod.

With reference to the drawing, there is shown a paper cutter and edge trimmer apparatus 10 having a base 12 and a base cover 14 with an open slot 16 in cover 14 for the reciprocal, slidable movement (see arrows FIG. 1) of a mounted knife holder apparatus 20 to move along the guidance slot 16 in cutting paper 22 illustrated as being cut in FIG. 1. The base cover is hinged for movement by pin 18 between a closed paper cutting or edge perforation position snugly over the base 12 (see FIGS. 1 and 2 respectively) and an upright open position (see FIGS. 3 and 4) for the placement of an edge perforated paper. The apparatus 10 also includes a paper edge guide 24 pivoted to move between a closed position snugly against one side of the base 12 and cover 14 (see FIGS. 2 and 4) and an open edge, paper guiding position extending perpendicularly outwardly from the base (see FIGS. 1, 3 and 4) so that one raised edge of the paper may be placed against the raised back edge 40 of the guide 24 so that the paper cut by the movement of the knife holder 20 will be cleanly cut and parallel to the paper edge. The edge guide 24 includes an elongated slot 28 along the lower base of the guide 24 and a reciprocal, short slidable paper edge guide 26 positioned in the slot 28 for movement therein so as to be mounted in a flush manner against the one opposite edge of the paper being cut (see FIG. 1 and arrows illustrating movement).

Figure 5:
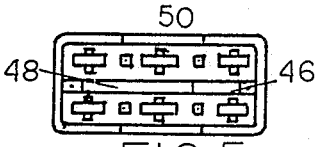
FIG. 5 is bottom plan view of the slidable knife holder of the paper cutting and trimming apparatus of the invention.
Figure 6:
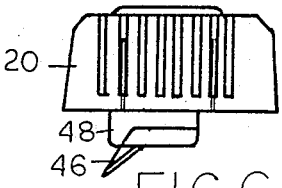
FIG. 6 is a side plan view of the slidable knife holder of the paper cutting and trimming apparatus of the invention.

The apparatus 10 includes a narrow, elongated glass strip (or other hard material) 36 on the top surface of the base 12 to form a hard surface against which the paper 22 can be cut with the movement of the knife 46 in the knife holder 20. The base 12 includes on the top surface a plurality of teeth holes 38 adjacent and parallel to the strip material 36. An elongated, rotatable rod 50 within the base has a plurality of spaced teeth-like elements 42 secured thereto for rotatable movement with the movement of the exterior lever arm 32 secured to the rod between a teeth-protruding position wherein the teeth extend through the teeth holes 38 and a short distance, e.g. $\frac{1}{8}''$ to $\frac{1}{4}''$, above the top surface of the base (see FIG. 3). In this teeth-extending position and with the top cover 14 in the upright position, the perforated edge, for example, of computer print out paper, can be placed on the extended teeth 42 (the spacing of the holes 38 and the teeth 42 of course can be varied, but would normally be at the same standard spacing as computer paper perforations). The perforated edge of the computer paper 34 can then be removed by tearing off by the user, preferably but not necessarily with the top cover 14 in the closed position (see FIG. 3). The lever arm 32 can then be rotated, e.g. 90°, so that the teeth elements 42 are rotated to a position below the top surface of the base 12, i.e. a non-use position, so that the apparatus 10 may be used as a paper cutting apparatus. The top cover 14 is of sufficient height so that the cover 14 can be closed with the teeth in the upright position; however, this would limit the effective cutting of paper in not presenting a flat top surface on the base 12 for the cutting operation. The edge guide 24 has at the one end a short, inwardly extending edge 60 which fits into recess 54 at the one end of the base 12, the top raised edge 40 of the edge guide 24 and the raised edge 52 of the base 12, each extending slightly above the top surface of the base 12 when the edge guide is in a closed position adjacent the side of the base 12 so that when the top cover 14 is in a closed position adjacent the raised edge 52, the edge guide cannot be moved to a paper edge guiding extended position. The cutting, slidable knife holder apparatus 20 (see FIGS. 5 and 6) comprises a plastic, removable holder 48 and a commercially available, triangular-type cutting blade or knife 46 removably secured in the holder 48. The knife apparatus 20 has a plurality of tension-biased, nylon-type rollers for ease in slidable movement. In use, the user merely presses slightly downward on the top of the knife apparatus 20 to overcome the bias and to place the edge of the knife against the paper to be cut and slide the knife apparatus 20 in the slot 16 to cut the paper 22 against the glass strip 36 directly under the slot 16 and the slidable knife blade 46. Preferably, but optionally, resilient material, such as a friction-type foam or rubber pad may be secured to the bottom surface of the base to prevent undesirable movement of the apparatus 10, to prevent damage to a surface and to cushion the apparatus in use. Also, preferably and optionally, a metric-English measurement may be printed or embossed on the top surface of the base 12 and/or on the raised surface 44 or bottom surface 48 of the edge guide 24 for ease in use in cutting paper to the desired size.

The described apparatus 10 provides in combination a compact, transportable, efficient paper cutting and perforated edge paper trimming apparatus.

What is claimed is:

1. A paper cutter and perforated edge paper trimmer apparatus, which apparatus comprises:

(a) an elongated, rigid base means to hold paper for cutting and trimming, the base means having a one side and an other side and a one and other end and having a flat top surface thereon for placement of paper to be cut or perforated edge paper to be trimmed and having:

(i) an elongated strip of a hard material on the top surface of the base means against which hard material the paper can be cleanly cut with a knife cutting edge; and (ii) a plurality of spaced apart, open spaces in the top surface of the base means in an elongated pattern generally parallel and adjacent to the hard strip material on the surface of the base means;

(b) a perforated edge paper holding means which comprises an elongated rotatable rod element within the base, means the rod element having a one end and an other end, and which rod element has a plurality of fixed, spaced apart teeth elements therein aligned in a mating relationship with the plurality of open spaces in the top surface of the base, means the rod element mounted rotatably within the base for rotational movement between a non-holding position where the teeth elements are disposed below the top surface of the base means and a perforated edge holding position wherein the teeth elements protrude generally vertically upward through the open spaces in the top surface of the base means and are adapted to receive and retain the perforated edge portion of a computer printout sheet so that the edge portion may be torn away against the upright teeth in the perforated edge holding position;

(c) a lever means secured to the rod element at the one end of the rod element and outside of the base means to rotate the rod element and the teeth elements secured thereto between the perforated edge holding position and non-holding position;

(d) a base cover means hingedly connected at the other end of the base means and adapted to move between an open position for the insertion of paper to be cut or trimmed on the base surface and a paper cutting or trimming position when the cover is in a closed position and in a matingly closed arrangement over the top surface of the base means, the base cover means including an elongated groove therein which is positioned over the elongated hard strip of material on the top of the base means surface when the base cover means is in the closed position;

(e) a paper cutting means to cut paper when the base cover means is in the closed position and the paper is retained between the base cover means and the top surface of the base means and across the elongated strip of hard material and which paper cutting means comprises a knife holder mounted for slidable movement in the elongated groove on the base cover means and which knife holder includes a tension loaded knife having an edge whereby when the base cover means is in the closed position, hand pressure on the top of the knife holder places the tension loaded edge of the knife in a cutting position and permits the paper to be cut against the elongated hard strip material beneath the knife edge to provide a smooth, clean paper cutting operation; and (f) a paper edge guide means to retain the one edge of the paper to be cut or trimmed, the paper edge guide means comprising an elongated guide element hingedly connected at the one end to the other end of the base means and adapted to move between an open, edge guiding position wherein the edge guide means extends generally perpendicularly from the one side of the base means and a closed position against the one side of the base means.

2. The apparatus of claim 1 wherein the paper edge guide means includes an elongated groove therein extending substantially the length of the paper edge guide means and which paper edge guide means includes at the other end a short, slidable paper edge guide means adapted for slidable movement within the groove elongated of the paper edge guide means when the paper edge guide means is in the open position, the short, slidable paper edge guide means extending generally parallel to the one side of the base means.

3. The apparatus of claim 2, wherein the base means comprises at the one therein end an upwardly raised edge, formed integrally with the base means, leaving a U-shaped raised edge at the one end of the base means to receive therein one end of the base cover means in the closed position and to retain the base cover means in a secured position when the base cover means is in the closed position, the base means having a recess to receive therein the short, slidable paper edge guide means extension of the paper edge guide means when the paper edge guide means is in the closed position.

4. The apparatus of claim 2 wherein the short, slideable edge guide means in the closed position is retained in the closed position when the cover means is in the closed position by a projection on the short, slideable edge guide means which fits within a slot in the coder means to prevent the paper edge guide means from being moved outwardly to the open position when the cover means is in the closed position.

5. The apparatus of claim 1 wherein the elongated hard strip material comprises a glass material.

6. The apparatus of claim 1 wherein the paper edge guide means includes an elongated, raised edge which extends along the one side of the base cover means in the closed position and which is raised slightly above the top surface of the base means.

* * * * *

UNITED STATES PATENT AND TRADEMARK OFFICE

CERTIFICATE OF CORRECTION

PATENT NO. : *4,967,628*

DATED : *November 6, 1990*

INVENTOR(S) : *Thomas W. Judd et al*

It is certified that error appears in the above-identified patent and that said Letters Patent is hereby corrected as shown below:

*Column 6, line 19, delete "therein" and insert -- thereof--;*

*Column 6, line 34, delete "coder" and insert --cover--.*

Signed and Sealed this

Tenth Day of March, 1992

*Attest:*

HARRY F. MANBECK, JR.

*Attesting Officer*

*Commissioner of Patents and Trademarks*